US005499264A

United States Patent [19]

Schaller et al.

[11] Patent Number: 5,499,264

[45] Date of Patent: Mar. 12, 1996

[54] PROCESS AND ARRANGEMENT FOR OPERATING A DOUBLE FURNACE INSTALLATION

[75] Inventors: Hans-Ludwig Schaller, Moers; Horst Mellinghoff, Mülheim; Michael Schmengler, Duisburg; Uwe Mager, Castrop-Rauxel, all of Germany

[73] Assignee: Mannesmann Aktiengesellschaft, Düsseldorf, Germany

[21] Appl. No.: 185,552

[22] Filed: Jan. 24, 1994

[30] Foreign Application Priority Data

Jan. 25, 1993 [DE] Germany ..... 43 02 285.5

[51] Int. Cl.[6] ..... F27D 23/00

[52] U.S. Cl. ..... 373/78; 373/80

[58] Field of Search ..... 373/8, 9, 43, 46–49, 373/78, 108, 80; 266/163

[56] References Cited

U.S. PATENT DOCUMENTS 3,612,740 10/1971 Gierek ..... 373/80
5,204,873 4/1993 Imagawa ..... 373/108

FOREIGN PATENT DOCUMENTS 2259907 8/1975 France .
3307400 1/1984 Germany .
3232139 3/1984 Germany .
3521569 12/1986 Germany .
3225514 3/1994 Germany .

*Primary Examiner*—Tu Hoang
*Attorney, Agent, or Firm*—Cohen, Pontani, Lieberman, Pavane

[57] ABSTRACT

A process for operating a double furnace installation having two arc furnaces connected via a line, a power supply, a device for charging material, and an arrangement for extraction and purification of gas. The process including the step of connecting a first one of the two furnaces with the power supply for melting a charge located therein, completely cutting off a second one of the furnaces from the power supply. The second furnace is then charged with charging material and is closed with a cover. Flue gas located in the closed second furnace is sucked out above the burden column and flue gas is sucked out of the first furnace above the surface of the melted charge through the second furnace via the connection line provided between the two furnaces. A flue gas connection of the first furnace to the gas purification arrangement is interrupted while the flue gas is being sucked out of the second furnace while feed air is simultaneously taken on in the region of a cover of the first furnace.

13 Claims, 2 Drawing Sheets

PROCESS AND ARRANGEMENT FOR OPERATING A DOUBLE FURNACE INSTALLATION

BACKGROUND OF THE INVENTION

1. Field of the Invention

The invention is directed to a steel making plant with a double furnace arrangement and a process for operating such a plant.

2. Description of the Prior Art

With the scarcity of energy sources and material growing more acute, there have been a number of suggestions for modelling the production of steel economically and in the most environmentally safe manner. Among these suggestions are the known steps for using the furnace gases extracted from the electric furnace for preheating the charging material. In so doing, the charging material, particularly scrap, is normally preheated in a charging basket.

Such a device is known from the German Patent 33 07 400. In this device, the warm waste gases of an arc furnace can be piped to the basket by means of a feed line and can flow through the scrap in the basket so as to heat it, then be returned subsequently to a gas purification installation.

In another process known from the German Patent 35 21 569, the basket which is filled with scrap is inserted into a preheating oven. This preheating oven is occupied by preheating gas which is heated via a treat exchanger. Tire furnace gas extracted from an electric furnace is guided on its way to the dust-removing installation by the heat exchanger.

The subject matter of both patents mentioned above requires a high construction cost and an abundance of maintenance-intensive structural component parts. Moreover, the repeated refilling of the charging material in various vessels leads to a reduction in the energy which can be exploited from the flue gases.

As concerns the use of more than one furnace, suggestions are known for decreasing the quantity of subassemblies or component groups belonging to the furnace. Thus, it is known from the German Patent 32 25 514 to provide a swivelable cover in a double-hearth arc furnace jointly for both furnace hearths, which cover can be placed on one of the two hearths alternately. This complicated and sensitive construction requires not only high maintenance costs but leads continually to obstructions in the production process.

SUMMARY OF THE INVENTION

Accordingly, it is an object of the present invention to avoid the disadvantages mentioned above and to provide, with the use of simply designed structural component parts, a low-maintenance and thus reliable steel making plant with a double furnace arrangement and to indicate the process pertaining thereto for melting steel in an environmentally safe manner.

Pursuant to this object, and others which will become apparent hereafter, one aspect of the present invention resides in a double furnace arrangement including two furnace vessels which can be closed by covers. Flue gas elbows connect to the covers with a gas purification installation. A connection line connects together the upper parts of the two furnace vessels and the connection line has a radial separation which permits a radial movement of outlets of the connection line. The radial separation can be closed in a gas tight manner by shut off devices arranged in the connection line on each side of the separation.

The double furnace installation is operated by supplying one of the two furnaces with an electric current for melting the charge located therein while the other furnace is completely cut off from the power supply. The furnace which is cut off from the power supply is charged with a charging material and is subsequently closed with its cover. After closing the furnace which is cut off from the power supply, the gas located therein is sucked out above the burden column. The flue gas is then sucked out of the furnace connected with the power supply above the surface of the melt through the furnace which is cut off from the power supply via the connection line between the two furnaces. While the flue gas is being sucked out of the furnace that is cut off from the power supply the flue gas connection of the other furnace to the gas purification arrangement is interrupted. Feed air is taken on at the same time in the region of the cover of the furnace connected to the power supply.

In a further embodiment of the invention, a power supply having a single main power feed is provided and connected to the two furnaces. Electric switching elements are provided for completely severing one furnace from the power supply so as to enable an unimpeded operation of the other furnace.

According to the invention, two furnaces are connected by a line opening into the lower region of the upper vessel. The furnaces are switched electrically so that only one furnace operates at any given time, while the second is completely severed from the power supply. The furnace which is severed from the power supply is charged with a burden, substantially tightly closed by means of a cover, and connected by a line with the dust-removing installation by means of a flue gas elbow provided in the cover. A pressure booster which generates a vacuum pressure when operating in the furnace which is not supplied with current is provided in the line between the furnace and dust-removing installation. This causes gas to be withdrawn from the burdened furnace so that flue gas is sucked out of the operating furnace through the connection line connected with this furnace. At the same time, another flue gas elbow provided in the operating furnace is blocked so that the feed air is taken on substantially from the region of the line of sealing between the cover and the vessel. The path of the gas accordingly runs from the region above the burden in the operating furnace through the scrap column above the surface of the melt via the connection line to the neighboring furnace, flowing diagonally through the furnace and, in so doing, imparting heat to the scrap, passes above the burden column through the flue gas duct and finally into the gas purification installation from which it is released into the atmosphere. No structural component parts are required other than the connection line provided with fittings. There is no unnecessary loss of heating energy, since the burden remains directly in the vessel in which it is subsequently melted.

The connection line presents a low-maintenance structural component part of simple construction. The blocking elements or shut-offs are not exposed to any special stresses and have been proven in practice.

With tiltable furnace vessels, the connection line has a radial separation in its center. This separation can be closed in a gaslight manner by means of a sliding sleeve.

The connection line can open into a special pocket-shaped construction in the lower vessel. One advantage of this pocket is that it does not impede the burden column and, moreover, it protects the outlet of the connection line against damage by the scrap pieces. Natural-gas burners and/or oil-oxygen burners are also installed in addition in order to substitute for electrical energy and to shorten the tap-to-tap time. The efficiency of these burners decreases progressively depending on their switch-on time, since these burners which are usually rigidly arranged only burn a hole in the scrap to a varying extent. The hot combustion gases escape into the gas purification installation without being utilized. However, in the proposed double furnace, these gases can be used directly for additional heating of the furnace not in electrical operation. The efficiency of these burners can accordingly be increased or the switch-on time of the burners can be lengthened in a meaningful manner.

The supply of energy by only one electric main line having its own lines in the region of the furnaces which can be severed by switches as well as the use of two covers clearly departs from the previously used method. The invention makes use of robust, proven, extremely low-maintenance structural component parts which work in rough steel making operations in the shortest time in a more economical and reliable way than the method of operating both furnaces with a movable cover and corresponding electric line.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
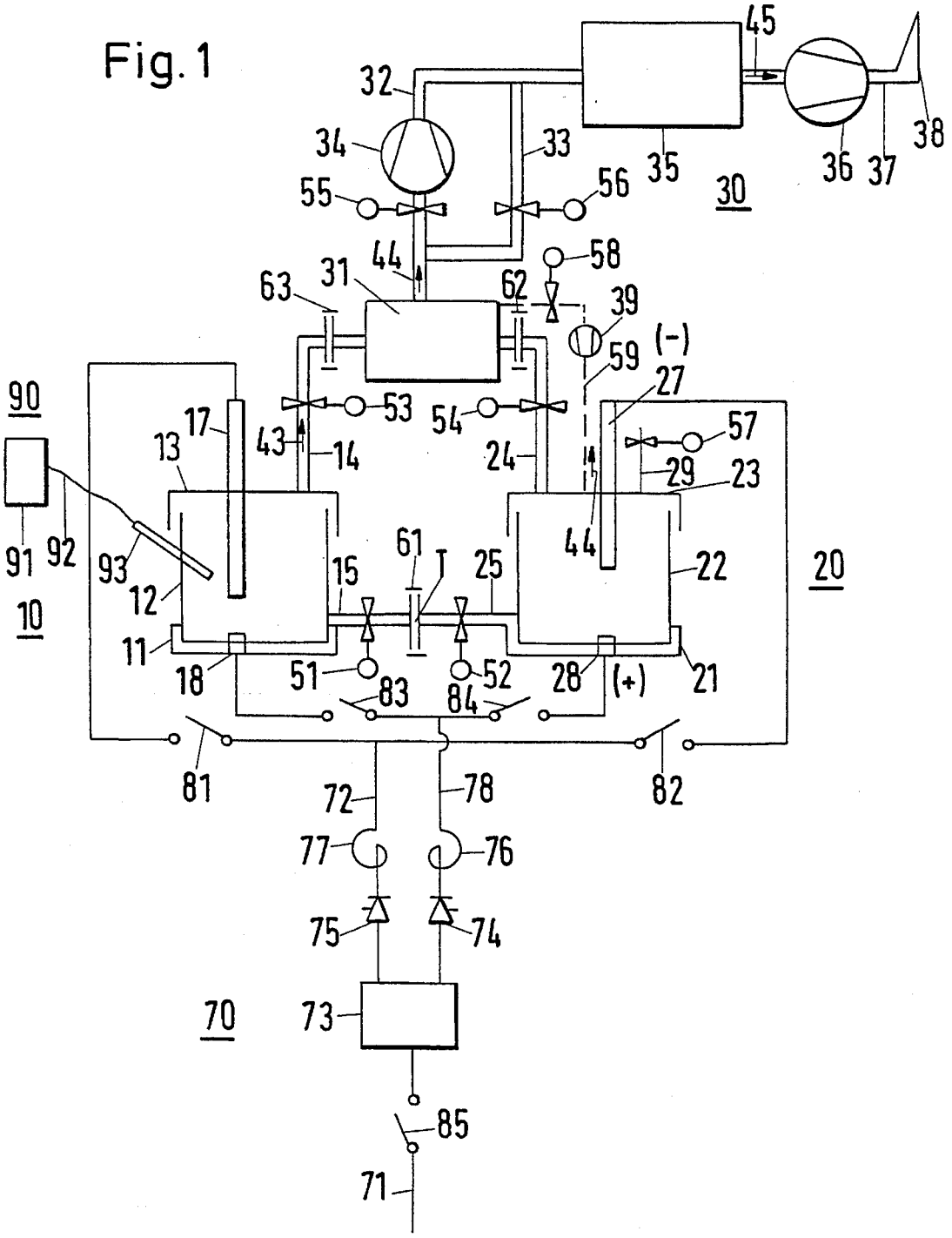
FIG. 1 shows a schematic diagram of the double furnace installation pursuant to the present invention.

FIG. 1 shows the furnaces 10 and 20 with bottom vessel parts 11, 21 and top vessel parts 12, 22 which can be closed by covers 13, 23. Flue gas lines 14, 24 leading to an afterburner 31 of a gas purification arrangement 30 are connected to the covers 13, 23. Shut-off valves 53, 54 and, further along the line, sliding sleeves 62, 63 are provided in the flue gas lines 14, 24.

The furnaces 10 and 20 are connected via connection lines 15, 25 which have a sliding sleeve 61 and a radial separation T at their ends. The connection lines 15, 25 also have shut-off valves 51 and 52.

A feed air line 29 which can be closed by means of a shut-off 57 is provided at the cover 23 of the furnace 20.

A burner 93 leading via a feed line 92 to a supply station 91 of the auxiliary burner arrangement 90 projects into the top part 12 of the furnace 10.

The after-burner 31, which is connected with the furnaces 10, 20 via the flue gas lines 14, 24, has a gas main 32 connected with a filter 35. A gas line 37 having a suction device 36 and communicating with a stack 38 is connected to the filter 35. A pressure-booster blower 34 is provided in the gas main 32. Upstream of the pressure-booster blower 34 is a shut-off 55. A bypass 33 which has a shut-off 56 bypasses the portion of the gas main 32 having the pressure-booster blower 34 and the shut-off 55.

Electrodes 17, 27 project into the furnaces 10, 20 and base electrodes 18, 28 are arranged in the bottom vessel parts 11, 21. The electrodes 17, 27, which are formed as cathodes, are connected with a transformer 73 of a power supply 70 via a cathode feeder 72. The base electrodes 18, 28, formed as anodes, are connected with the transformer 73 via an anode line 78. The power feed lines 72, 78 have furnace switches 81, 82 for the cathodes and furnace switches 83, 84 for the anodes, as well as thyristors 74, 75 and chokes 76, 77. A main power supply 71 is connected to the transformer 73 by a power supply switch 85.

A flue gas exhaust line 59 having a compressor 39 and a shut-off 58 is provided at the cover 23 of the furnace 20.

Also shown are the media 40 in the lines in question, i.e. flue gas 43, burned gas 44, and pure gas 45.

Figure 2:
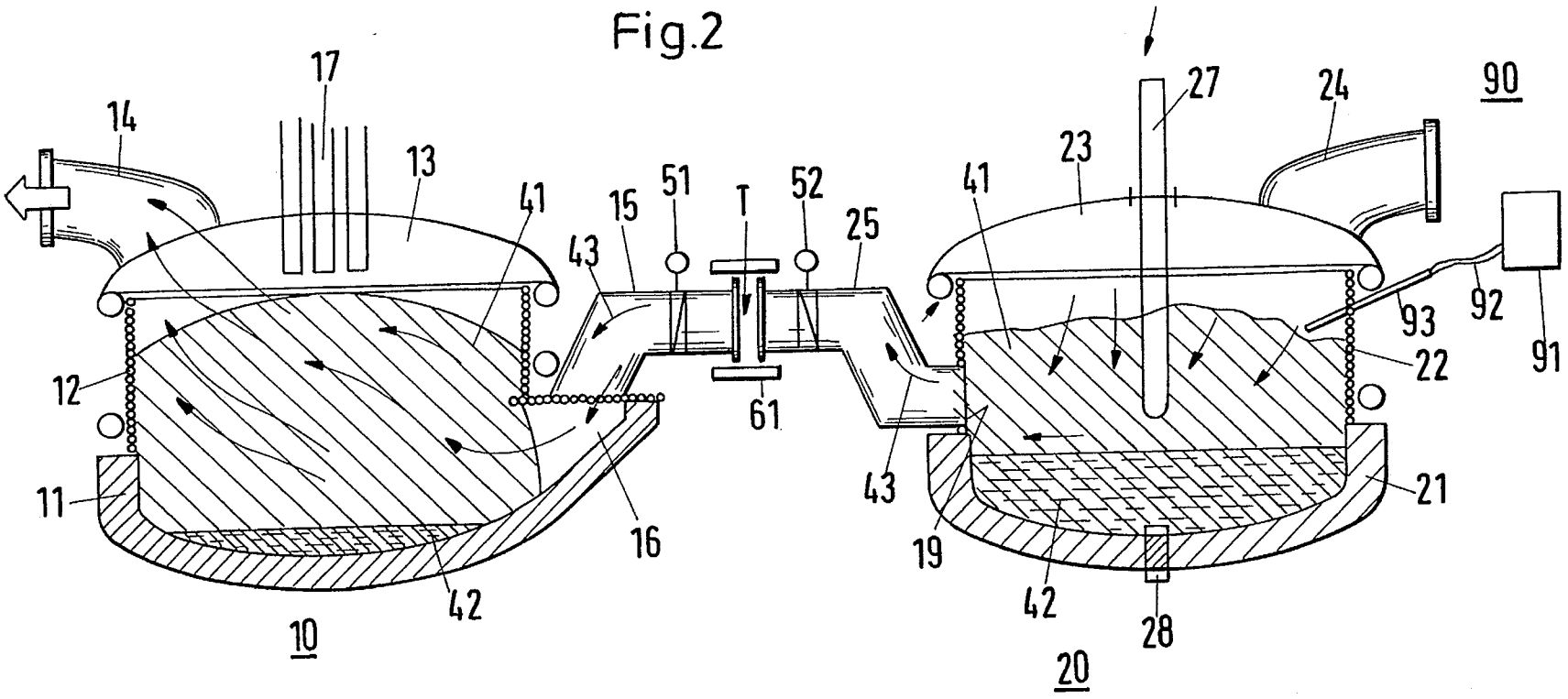
FIG. 2 shows the gas flow diagram during furnace operation.

FIG. 2, in which the same reference numbers are used as in FIG. 1, shows the furnaces 10 and 20 in section. This drawing also shows the direction of flow of the gas and a more detailed view of the burden 41 and the steel melt 42. In FIG. 2, the furnace 20 is in the melt phase; furnace 10 is freshly charged and connected with furnace 20 with respect to gas flow.

Further, this drawing shows in detail the possibility of arranging mainly at the bottom vessel part 11 a pocket 16 which enables a simple arrangement of the connection line 15 without impeding the burden column 41. In contrast, the tipper vessel in furnace 20 has a conventional cylindrical construction and a grate 19 is provided to prevent the burden 41 from flowing into the connection line 25.

The invention is not limited by the embodiments described above which are presented as examples only but can be modified in various ways within the scope of protection defined by the appended patent claims.

We claim:

1. A process for operating a double furnace installation having two arc furnaces connected via a line, a power supply, a device for charging material in a charging direction, and an arrangement for extraction and purification of gas, comprising the steps of: connecting a first one of the two furnaces with the power supply for melting a charge located therein; completely cutting off a second one of the furnaces from the power supply; tilting the second furnace at a radial separation of the line; charging the second furnace with charging material to form a burden column; closing the second furnace with a cover; sucking flue gas located in the closed second furnace out above the burden column; sucking flue gas out of the first furnace above the surface of the melted charge through the second furnace via the connection line provided between the two furnaces; interrupting a flue gas connection of the first furnace to the gas purification arrangement while the flue gas is being sucked out of the second furnace; simultaneously taking on feed air in a region of a cover of the first furnace; and feeding air to the flue gas in adjustable quantities.

2. A process according to claim 1, wherein the flue gas in the second furnace flows through the burden column opposite the charging direction.

3. A process according to claim 1, wherein the flue gas of the first furnace flows through the burden column in the charging direction.

4. A process according to claim 1, including branching off a portion of the flue gas burned in an after-burner chamber and using the branched off portion of flue gas as feed air.

5. A process according to claim 1, including additionally heating the charge in the first furnace with fuels.

6. A steel making plant, comprising: a power supply; a double furnace arrangement including: two furnaces having furnace vessels with top vessel parts, covers for closing the furnaces, a gas purification installation, flue gas elbows connecting the covers to the gas purification installation, a connection line directly connecting together the two furnaces and opening into the top vessel parts, the connection line having a radial separation which separates the connection line into two parts and permits independent tilting of the connection line parts and independent radial movement of outlets of the connection line, a sliding sleeve arranged so as to enclose the radial separation, and means for closing the separation in a gas tight manner, the closing means including a shut-off device arranged in the connection line on each side of the separation; a power supply having a single main power feed, the power supply being connected to the two furnaces; and electric switching means for completely severing one furnace from the power supply so as to enable an unimpeded operation of the other furnace.

7. A steel making plant according to claim 6, wherein the power supply is a DC power supply and anodes are arranged in the furnaces, the individual furnaces having additional switches for cutting off power to the anodes.

8. A double furnace arrangement, comprising: two furnace vessels; covers for closing the furnace vessels; a gas purification installation; flue gas elbows connecting the covers to the gas purification installation; a connection line directly connecting together the two furnace vessels, the connection line having a radial separation which separates the connection line into two parts and permits independent tilting of the connection line parts and independent radial movement of outlets of the connection line; a sliding sleeve arranged so as to enclose the radial separation; and means for closing the separation in a gas tight manner, the closing means including a shut-off device arranged in the connection line on each side of the separation.

9. A double furnace arrangement according to claim 8, wherein the connection line has outlets at an outer edge of the vessel parts that is arranged diagonally to an outlet of the flue gas elbows of the covers.

10. A double furnace arrangement according to claim 8, wherein each of the furnace vessels has a top vessel part, at least one of the top vessel parts forming at least part of a pocket-shaped region.

11. A double furnace arrangement according to claim 8, wherein each of the furnace vessels has a top vessel part, a top vessel part of one of the furnace vessels having a grate therein and the top vessel part of the other furnace vessel defining at least part of a pocket-shaped region, the connection line directly connecting together the grate of the one furnace vessel and the pocket-shaped region of the other furnace vessel.

12. A double furnace arrangement, comprising: two furnace vessels; covers for closing the furnace vessels; a gas purification installation; flue gas elbows connecting the covers to the gas purification installation; a connection line directly connecting together the two furnace vessels, the connection line having a radial separation which separates the connection line into two parts and permits independent tilting of the connection line parts and independent radial movement of outlets of the connection line; a sliding sleeve arranged so as to enclose the radial separation; means for closing the separation in a gas tight manner, the closing means including a shut-off device arranged in the connection line on each side of the separation; combustion energy supply means; and burners connected to the combustion energy supply means and arranged so as to project into an upper part of the double furnace.

13. A double furnace arrangement comprising: two furnace vessels; covers for closing the furnace vessels; a gas purification installation; flue gas elbows connecting the covers to the gas purification installation; a connection line directly connecting together the two furnace vessels, the connection line having a radial separation which separates the connection line into two parts and permits tilting of the connection line parts and independent radial movement of outlets of the connection line; a sliding sleeve arranged so as to enclose the radial separation; and means for closing the separation in a gas tight manner, the closing means including a shut-off arranged in the connection line on each side f the separation, the furnace vessels each have a bottom vessel, part, the connection line opening into a region of the top vessel part of each furnace vessel that slopes toward the bottom vessel part, the connection line having outlets at an outer edge of the vessel parts that is arranged diagonally to an outlet of the flue gas elbows of the covers.

* * * * *